United States Patent [19]

Gray et al.

[11] Patent Number: 4,602,471

[45] Date of Patent: Jul. 29, 1986

[54] ROLL-UP METHOD AND APPARATUS FOR MINERAL FIBER PACK

[75] Inventors: William E. Gray, Granville; Ronald R. Harris, Newark, both of Ohio

[73] Assignee: Owens-Corning Fiberglas Corporation, Toledo, Ohio

[21] Appl. No.: 737,856

[22] Filed: May 28, 1985

[51] Int. Cl.[4] ..... B65B 11/56; B65B 63/02

[52] U.S. Cl. ..... 53/430; 53/118; 100/40; 100/88

[58] Field of Search ..... 53/430, 118; 100/40, 100/78, 88; 242/55, 67.1 R

[56] References Cited

U.S. PATENT DOCUMENTS

| | | | |
|---|---|---|---|
| 2,971,300 | 2/1961 | Hobbins | 53/439 X |
| 3,133,386 | 5/1964 | Johnston | 53/26 |
| 3,911,641 | 10/1975 | Miller et al. | 53/118 X |
| 3,927,504 | 12/1975 | Forrister | 53/461 X |
| 3,964,235 | 6/1976 | Miller et al. | 53/118 |
| 3,987,752 | 10/1976 | Miller | 53/118 X |
| 3,991,538 | 11/1976 | Finn et al. | 53/118 X |
| 4,085,562 | 4/1978 | Finn et al. | 53/118 X |
| 4,114,530 | 9/1978 | Miller | 53/118 X |
| 4,163,353 | 7/1979 | Finn et al. | 53/430 |
| 4,164,177 | 7/1979 | Canfield | 53/118 X |
| 4,353,512 | 10/1982 | Rohrbacher | 53/118 X |

*Primary Examiner*—James F. Coan

*Attorney, Agent, or Firm*—Ronald C. Hudgens; Greg Dziegielewski; Ted C. Gillespie

[57] ABSTRACT

Apparatus and method for packaging flexible compressible strips of mineral fibers into rolls comprises an endless belt, means for supporting the belt in a manner to define a loop inside which the strips can be rolled, and a compression member from maintaining the strip in compression upstream from the loop, where the compression member is mounted for movement toward and away from the loop.

6 Claims, 5 Drawing Figures

ROLL-UP METHOD AND APPARATUS FOR MINERAL FIBER PACK

TECHNICAL FIELD

This invention relates to apparatus and a method for packaging strips of compressible material into a compressed roll. In one of its more specific aspects, this invention pertains to packs of fiberous mineral insulation, which are compressed and rolled up into rolls while the compression is maintained. The method and apparatus of this invention are suitable for use in packaging glass fiber insulation material.

BACKGROUND OF THE INVENTION

Compressible strip material, such as fiberous glass insulation, can be removed from a conveyor and packaged in a belt roll-up which uses a loop to help roll the insulation pack upon its self. The length of the belt is controlled as the material is fed into the loop so that the package reaches its final predetermined diameter at the time the end of the pack enters the loop. The length of the belt, and thus the size of the loop, is allowed to grow as the pack is fed into the loop by a means which places the belt drive into contact with the pack at a faster rate than it removes the belt from the loop. The operatiton of belt roll-up equipment is well known in the art. See, for example U.S. Pat. No. 3,911,641.

One of the important considerations in packaging flexible strip material, such as fiberous glass insulation, is the need to avoid over-compression of the material. Fibers are bonded together with organic binder, and over-compression of the pack results in breaking the glass fibers and/or rupture of the bonds between the glass fibers. This results in a much lower recovery or free expansion height of the pack after it is unpackaged in its ultimate destination, such as, for example, an attic of a house. The lower recovery and lesser thickness of an over-compressed pack results in a lower total resistance to heat flow and a lower R-Value. It has also been shown that repeated compression of the insulation material degrades its thermal performance. If a pack is compressed, allowed to expand, and then recompressed, its thermal properties will be degraded. Thus, it is desirable to provide a packaging method allowing the maximum compression of the insulation material while avoiding degradation of the insulation value through damage to the recovery properties of the pack.

In order to avoid over-compression of the pack, and to prevent inadvertent expansion and recompression immediately prior to rolling up the insulation pack, it has been proposed to provide a compression member, such as a compression chute to maintain the pack in compression immediately prior to feeding the pack into the roll-up apparatus. This proposed solution is only partially satisfactory, because it requires a positioning of the chute tip close enough to the roll that the tip interferes with the front or leading edge of the pack during the initiation of the roll of the pack. This problem is particularly prevalent when the pack has a facing of such materials as foil or paper, because the facing strikes the chute tip and the pack is damaged. Thus, this one proposed solution to the expansion and recompression problem has resulted in a problem of wool delamination and peeling back of the facing of the leading edge of the wool.

If the compression chute is moved back away from the roll-up apparatus, then the wool can expand before entering the roll-up apparatus, forming a zone of expansion or "bubble". The problem caused by the "bubble" of wool expansion between the chute tip and the roll is that the top surface of the bubble scrapes against the belt, which is traveling in the opposite direction. This scuffing action results in degradation of the surface appearance of the pack and contributes to product dustiness.

STATEMENT OF THE INVENTION

There has now been developed a process and apparatus which enables packaging of compressible material in a manner which prevents expansion and recompression of the material without resulting in delamination or damaging of the facing in the pack as the leading edge of the pack is formed into a roll. A compression chute is provided to compress the insulation pack to the desired level. The compression chute is positioned at an upstream position during the initiation of the roll-up of the pack, and the chute is moved toward the loop, to a downstream position, after the initiation of the roll-up in order to maintain compression of the pack.

According to this invention, there is provided apparatus for compressing and rolling a flexible compressible strip of mineral fibers into a roll comprising an endless belt, means for supporting the belt in a manner to define a loop inside which the strip can be rolled, and a compression member for maintaining the strip in compression upstream from the loop, the compression member being mounted for movement toward and away from the loop.

In a specific embodiment of the invention, means for driving the compression member toward the loop during the roll-up of the strip are provided.

In a preferred embodiment of the invention there are provided means for detecting the presence of the strip and means responsive to the detection of the strip to initiate movement of the compression member toward the loop.

According to this invention, there is also provided a method for compressing and rolling a flexible strip of mineral fibers into a roll comprising defining a loop in an endless belt for rolling up a strip, maintaining the strip in compression upstream from said loop with a compression member, the compression member being mounted for movement toward and away from the loop, the compression member being initially positioned away from the loop, initiating movement of the strip into the loop, and moving the compression member toward the loop after the rolling up of the strip has been initiated.

In a specific embodiment of the invention, the presence of the strip is detected and the movement of the compression member toward the loop is initiated in response to the detection of the strip.

In a preferred embodiment of the invention, the end of the strip is detected and the compression member is moved away from the loop in response to detection of the end of the strip.

DESCRIPTION OF THE INVENTION

The invention will be described in terms of a glass fiber insulation packaging operation, although it is to be understood that the invention can be practiced using packs or compressible strips of other flexible materials, such as insulation packs of mineral materials such as rock, slag or basalt fibers.

Figure 1:
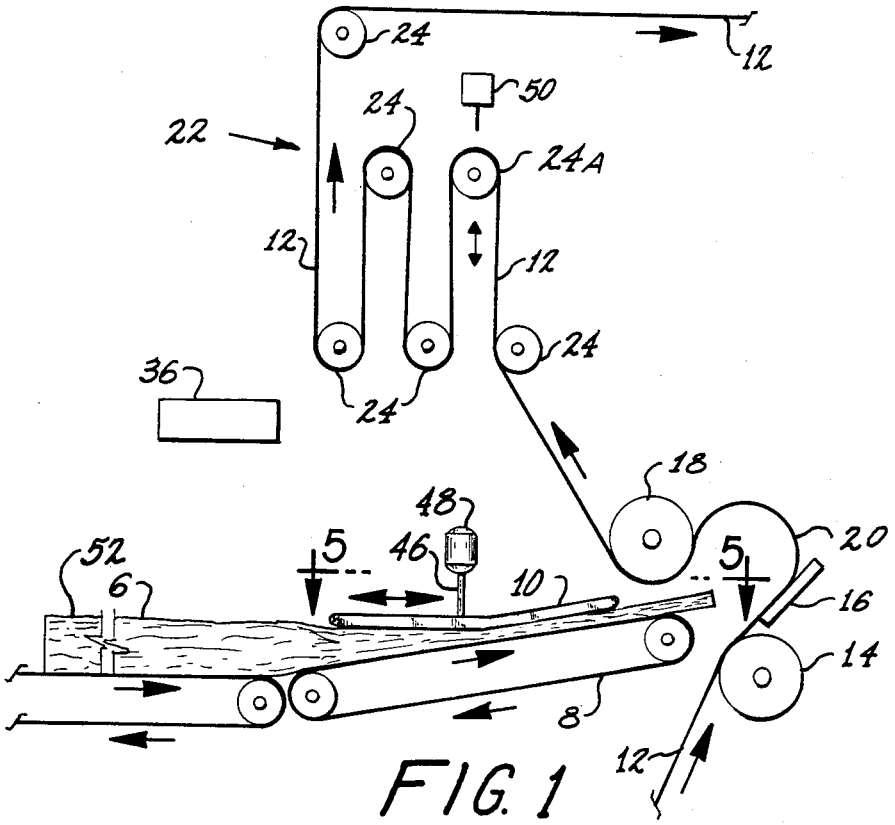
FIG. 1 is a schematic view in elevation of the apparatus of the invention.

As shown in FIG. 1, pack 6 is compressed on incline conveyor 8 by chute 10. The chute can be any kind of compression member suitable for compressing the insulation material to the desired amount of compression. The insulation pack in FIG. 1 has just begun to pass the chute and the insulation package or roll is not yet being formed. Roll-up belt 12 is supported and driven by drive roll 14, loop support 16 and upper throat roll 18 to define belt loop 20 in which the insulation pack is rolled up. These parts function in a manner well known in the art to cause the belt loop to expand as the roll within the loop increases in diameter.

The belt roll-up can be equipped with belt takeup system 22 comprising rollers 24. One or more of the rollers 24A, can be mounted for vertical movement to accommodate the take-up of some of the belt into the belt loop as the roll grows in size, in the manner well known in the art.

Figure 2:
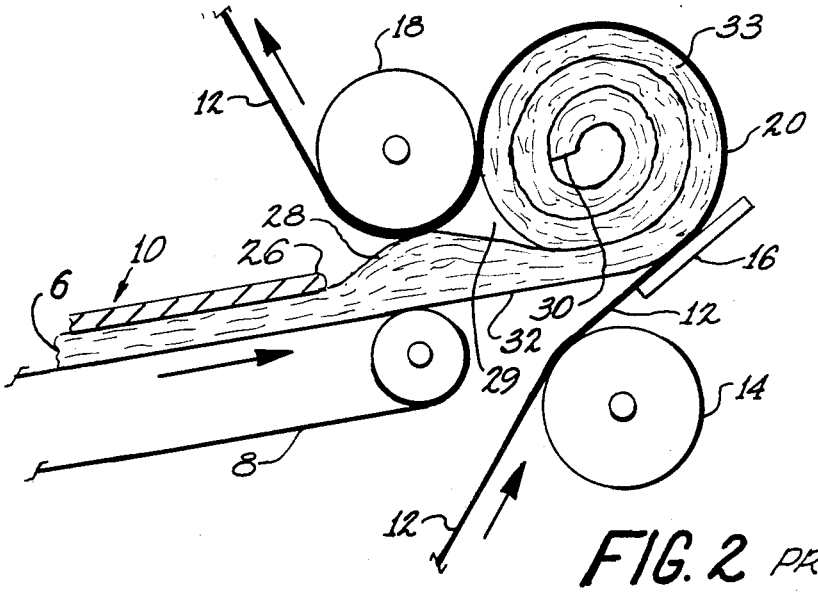
FIG. 2 PRIOR ART
FIG. 2 is a schematic view of the chute tip and belt loop of a prior art belt roll-up apparatus indicating the expansion "bubble".

As shown in FIG. 2, when the chute tip 26 is positioned relatively upstream from the belt loop, the insulation material can expand as it passes between the chute tip and the roll to form a "bubble" 28. The presence of the bubble means that the wool is expanding and then recompressed during the roll-up process, thereby degrading the insulation properties of the pack. Also, the bubble comes into contact with the belt as the belt travels around the upper throat roll, thereby causing scuffing or abrasive action on the surface of the pack which degrades the surface of the pack and causes dustiness.

Figure 3:
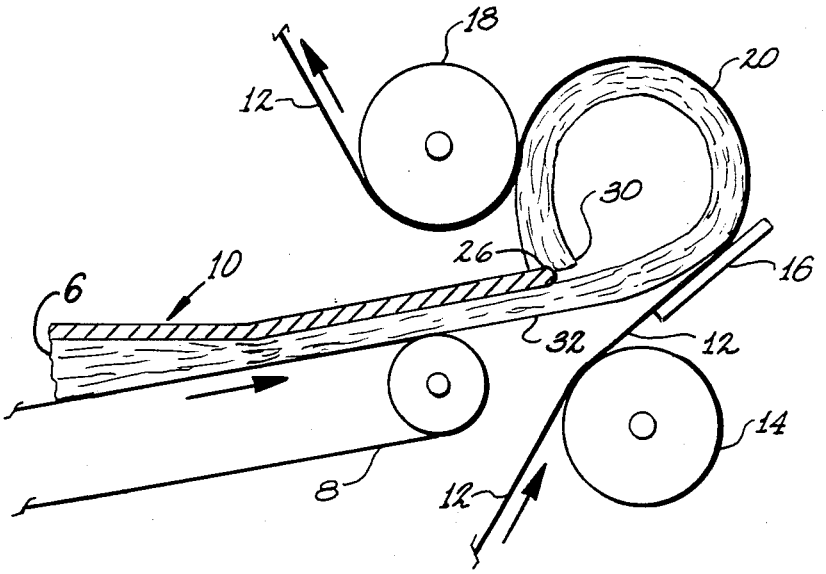
FIG. 3 PRIOR ART
FIG. 3 is a schematic view in elevation of the chute tip and belt loop of a prior art roll-up indicating delamination of the leading edge of the pack during initiation of the roll-up.

As shown in FIG. 3, the fixed positioning of the chute tip in a relatively downstream position, close to the nip 29 of the insulation roll, to prevent the bubble results in contact between leading edge 30 of the insulation pack with the chute tip. This contact causes delamination of the pack and peeling back of facing 32 on the pack.

Figure 4:
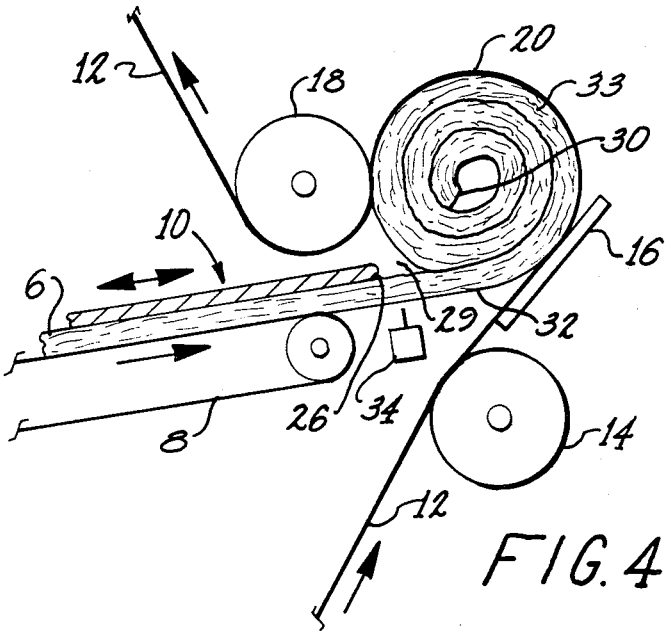
FIG. 4 is a schematic view in elevation of the belt roll-up apparatus of the invention.

As shown in FIG. 4, the apparatus of the invention includes chute 10 which is movable into upstream and downstream positions with controlled positioning between these extremes. The upstream position enables the pack to begin to be rolled up into roll 33 without contact with the chute tip. The downstream position, as shown in FIG. 4, enables the pack to be rolled up without an expansion bubble between the chute tip and the belt loop.

The apparatus can be provided with any suitable means for sensing the presence of the leading edge of the pack in order to initiate the movement of the chute toward the loop. For example, sensor 34 can be a photocell. The sensor can be connected with any suitable controller, such as programmable controller 36 shown in FIG. 1, to receive signals from the sensor and to control the movement of the chute toward the loop after the roll-up process has been initiated.

Figure 5:
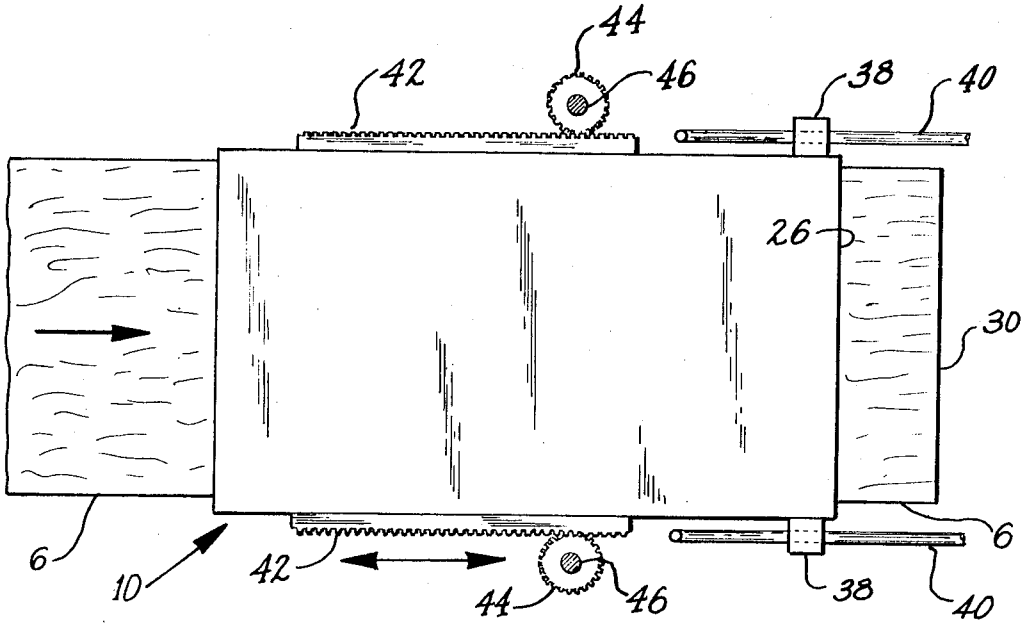
FIG. 5 is a schematic plan view of the apparatus of FIG. 1 taken along lines 5—5.

As shown in FIGS. 1 and 5, the chute is mounted for downstream and upstream movement, toward and away from the belt loop, respectively. Any means suitable for providing such movement can be employed. As shown, the chute is preferably adapted with sleeve bearings 38 to enable sliding movement of the chute along stationary guide rods 40. The movement of the movable chute can be effected in any suitable manner, such as by the use of rack 42 and pinion 44 attached to the chute. The pinions can be mounted on shafts 46 which can be driven by any suitable means, such as servomotor 48. The motor can be connected by means, not shown, to the controller for controlling the movement of the chute into the upstream and downstream positions.

One aspect of the belt roll-up which causes problems is that while the upper throat roll and drive roll are mounted for rotation in a fixed position, as the size of the insulation roll increases, the nip 29 moves downstream, in the direction of the belt loop. Absent a corrective movement of the chute tip toward the belt loop, the bubble might be re-formed. Thus, in the preferred embodiment, the size of the package is sensed, and the movement of the chute tip toward the belt loop is controlled responsive to the size of the package. Any means for sensing the size of the roll can be employed. As shown in FIG. 1, potentiometer 50 senses the vertical movement of moveable roller 24A, and this can be converted to an accurate measure of the size of the roll being formed. The potentiometer or other means for sensing can be connected to the programmable controller 36 which can control the movement of the chute toward the loop in response to the size of the roll as the insulation pack is rolled up into the roll.

The controller can be programmed to synchronize the movement of the chute tip toward the loop of the belt after the sensor detects the presence of the leading edge passing thereby. Likewise, at the end of the roll-up process, the tail end of the pack can be sensed by the sensor, and the chute can be retracted to the initial position, away from the loop.

It will be evident from the foregoing that various modifications can be made to this invention. Such, however, are considered as being within the scope of the invention.

INDUSTRIAL APPLICABILITY

This invention will be found to be useful in the packaging of glass fibers for such uses as thermal insulation and acoustical insulation.

We claim:

1. A method for compressing and rolling a flexible, compressible strip of mineral fibers into a roll, comprising defining a loop in an endless belt for rolling up said strip, maintaining said strip in compression upstream from said loop with a compression member, said compression member being mounted for movement toward and away from said loop, said compression member being initially positioned away from said loop, initiating movement of said strip into said loop, and moving said compression member toward said loop after the rolling up of said strip has been initiated.

2. The method of claim 1 comprising detecting the presence of said strip and initiating movement of said compression member toward said loop in response to the detection of said strip.

3. The method of claim 2 comprising sensing the size of the roll, and controlling the movement of said compression member toward said loop in response to the size of the roll as said strip is rolled up into the roll.

4. The method of claim 2 comprising detecting the tail end of said strip and moving said compression member away from said loop.

5. Apparatus for compressing and rolling a flexible, compressible strip of mineral fibers into a roll, comprising an endless belt, means for supporting said belt in a manner to define a loop inside which the strip can be rolled, a compression member for maintaining said strip in compression upstream from said loop, said compression member being mounted for movement toward and away from said loop, means for driving said compression member towards said loop during the roll-up of said strip, means for detecting the presence of said strip, and means responsive to the detection of said strip to initiate movement of said compression member toward said loop.

6. The apparatus of claim 5 comprising means for sensing the size of said roll and means for controlling the driving of said compression member responsive to the size of said roll.

* * * * *